United States Patent [19]

Decker

[11] 4,006,614

[45] Feb. 8, 1977

[54] WARNING LIGHT SECURITY DEVICE

[75] Inventor: Wilton K. Decker, Port Washington, Wis.

[73] Assignee: Safe-Lite, Inc., Menomonee Falls, Wis.

[22] Filed: Aug. 21, 1975

[21] Appl. No.: 606,700

[52] U.S. Cl. ..... 70/63; 70/371; 70/419

[51] Int. Cl.[2] ..... E05B 9/04; E05B 65/52

[58] Field of Search ..... 70/344, 345, 346, 347, 70/367, 369, 371, 419, 421

[56] References Cited

UNITED STATES PATENTS

| | | | |
|---|---|---|---|
| 538,074 | 4/1895 | Heizmann | 70/346 |
| 557,952 | 4/1896 | Bohannan | 70/346 |
| 1,360,289 | 11/1920 | Gunderson | 70/344 X |
| 1,434,161 | 10/1922 | Smith | 70/371 X |
| 1,982,813 | 12/1934 | Jacobi | 70/371 X |
| 3,486,355 | 12/1969 | Halfyard | 70/421 |
| 3,541,822 | 11/1970 | Murphy | 70/386 X |

FOREIGN PATENTS OR APPLICATIONS

| | | | |
|---|---|---|---|
| 1,292,033 | 4/1969 | Germany | 70/63 |
| 374,614 | 6/1932 | United Kingdom | 70/371 |

*Primary Examiner*—Robert L. Wolfe
*Attorney, Agent, or Firm*—Quarles & Brady

[57] ABSTRACT

A warning light housing includes a casing having an aperture which aligns with a chamber in the base to present a receptacle for receiving a plug-type lock. With the lock residing within the receptacle, separation of the base and casing is prohibited thus preventing access to the housing interior. The lock includes a latch element which is selectively movable between locking and non-locking positions by turning a key within the lock. In its locking position, the latch element extends radially outwardly from the lock periphery into a slot in the housing base to restrain the lock within the receptacle; and, in its non-locking position, the latch element lies within the lock periphery allowing removal of the lock from the receptacle.

10 Claims, 8 Drawing Figures

Fig. 3
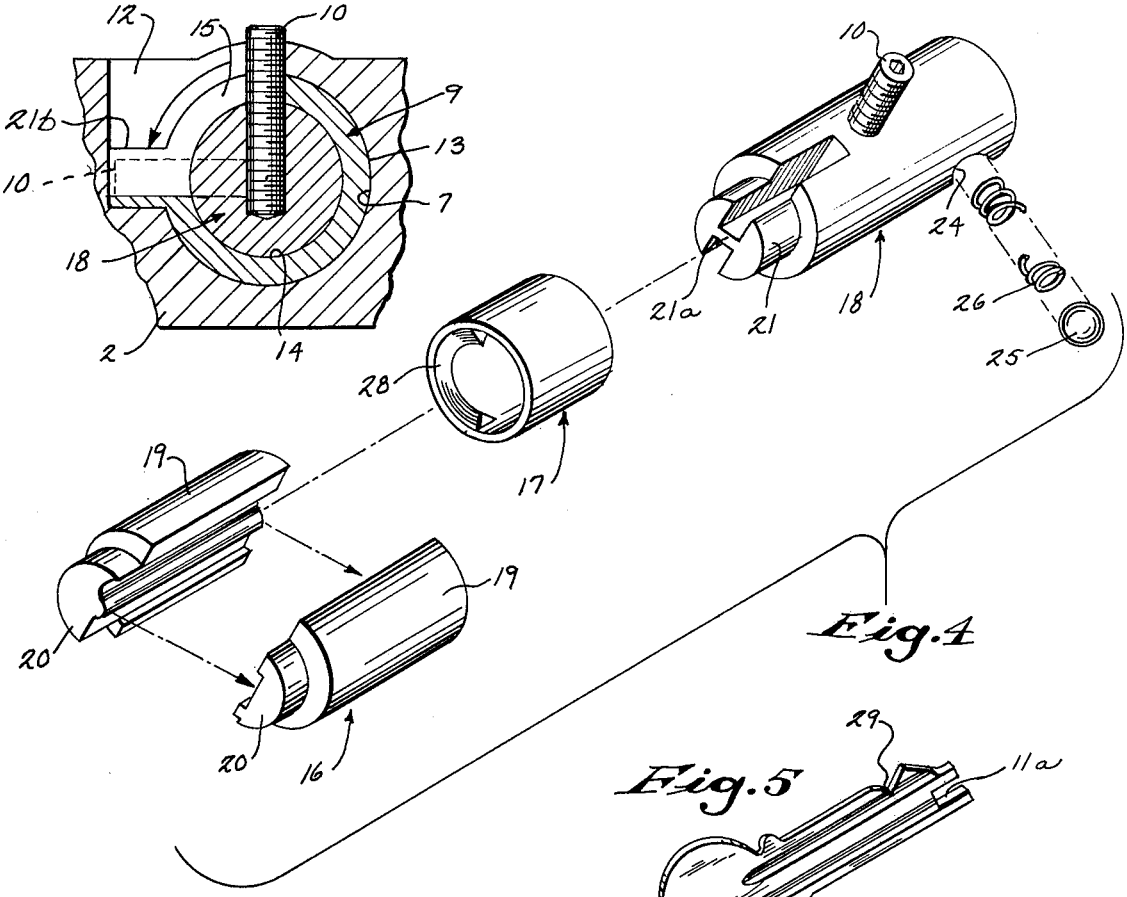
Fig. 4
Fig. 5
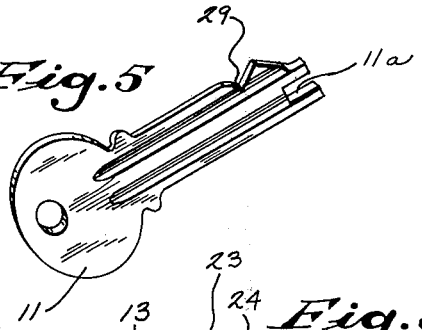
Fig. 6
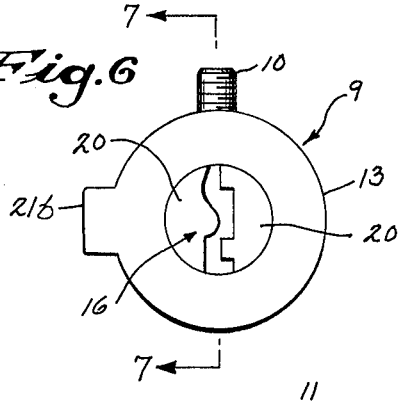
Fig. 8
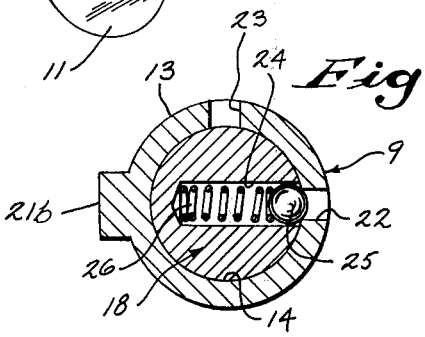
Fig. 7
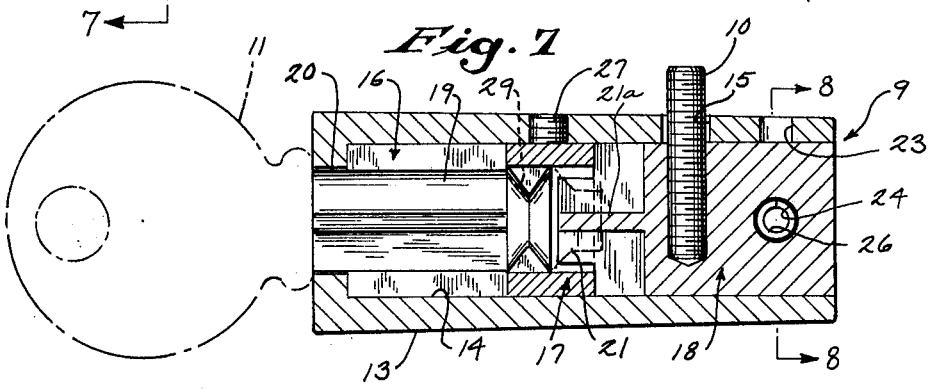

WARNING LIGHT SECURITY DEVICE

BACKGROUND OF THE INVENTION

The present invention relates to a plug-type lock, that is insertable in the aligned openings of two members to obstruct relative movement between the members. An example of an environment for such a lock is a casing and base forming the housing of a warning light as shown in U.S. Pat. No. 3,697,738, issued to Decker et al., on Oct. 10, 1972 for "Warning Light Housing."

Street construction barricades are commonly provided with electric warning lights to enhance vehicular safety. Since such warning lights are vulnerable to theft by delinquent persons, it is desirable to permanently mount them on the barricade to prevent larcenous removal. For example, in U.S. Pat. No. 3,015,804 the entire housing for a warning light is permanently attached to the barricade. On the other hand, permanent mounting structures generate serviceability problems. Warning lights require periodic upkeep, such as routine battery changes and bulb replacement, and parts repair necessitated by adverse weather conditions and rough handling by construction personnel. As a result, it is desirable to have a warning light housing that is easily removable from the barricade by authorized maintenance workers. In the aforementioned U.S. Pat. No. 3,697,738, to which reference may be had for further description, these conflicting difficulties are resolved by providing a housing including a base secured to the barricade and a casing affixed to the base. The constituents of the light system—batteries, switches, flasher circuit, lamp, wiring, etc.—are enclosed between the base and casing. A through bolt passes through a bore in the base and extends into an aperture in the barricade. A mounting nut and its surrounding nut cup are placed on the end of the bolt protruding into the barricade. A special tool is required to restrain rotation of the mounting nut as the bolt is turned into the nut fastening the base to the barricade. This type of mounting provides a semi-permanent attachment, in that separation of the housing from the barricade can be accomplished generally only through utilization of the special tool.

The noted arrangement is quite satisfactory, but it does present a problem in that, the connection between the base and casing is still somewhat susceptible to thievish tampering. A locking screw extends through an aperture in the casing into an internally threaded bore in the base. A recess encircles the aperture to present a substantially sunken enclosure for the locking screw in its fully tightened position. Despite this fastening deterrent, stealthy individuals have been able to achieve access to and purloin the components of the light system within the housing.

The present invention contemplates an improved locking device for holding the structural constituents of a warning light housing in secured relationship, and it is also intended for any other uses in which two members are to be locked together by insertion of a plug-type lock into the two members.

SUMMARY OF THE INVENTION

The invention resides in a plug-type lock having an outer barrel, a locking cylinder within the barrel that has a radially extending latch element movable between locking and non-locking positions by a rotation of the cylinder, and a key receptor at one end of the barrel that aligns with the locking cylinder.

A plug-type lock is one which is inserted bodily into aligned openings of two members to hold them in place and obstruct relative movement. It plugs the openings, and upon its removal the members are unlocked from one another. To maintain a locked condition a latch, or bolt, extending from the lock body is rotated into a caught position, and for removal the latch is turned into a position allowing retraction of the entire lock body from the members.

The present lock is key operated, and the parts within the lock are simplified, from comparison with a pin-tumbler cylinder lock. Springs and pins are eliminated, and an inexpensive construction is obtained that is highly suitable for applications where the items to be locked are not in themselves of substantial cost or value. The lock of the invention lends itself to use in quantity for the individual locking of a large number of like articles.

The lock in a preferred form has a barrel like housing in which a key receptor is mounted at an open end of the barrel. The key receptor is forward of a rotatable locking cylinder which carries the latch element. A key extends through the key receptor and into a suitable slot within the locking cylinder. Turning of the key imparts rotational movement of both the key receptor and the locking cylinder to selectively place the latch element in locking and non-locking positions. The key receptor is especially constructed to permit introduction of the appropriate key into the lock housing, and into engagement with the locking cylinder, but to obstruct insertion of a counterfeit device.

The lock may also include a collar non-rotatably interposed between the key receptor and the locking cylinder. This collar has a ridge which engages a mating notch in a key upon rotation of the latch element to its non-locking position, thus inhibiting withdrawal of the key from the lock while in the non-locking position. Thus, after removal of the lock, the key remains in the lock in readiness for relocking immediately upon reinsertion of the lock. This feature is particularly desirable, for it minimizes loss of keys and wasted time searching for a misplaced key.

It is an object of the invention to provide an inexpensive lock dispensing with tumbler pins and bias springs.

It is another object to provide a plug-type lock in which the operating key is held in the lock whenever it is in an unlocking position.

It is another object to provide a security device for inexpensive equipment, such as warning lights for traffic barricades.

It is a further object of the invention to provide a locking device for effectively prohibiting clandestine pilfering of internal parts of a warning light system, yet permit easy dismantling of the housing by authorized maintenance workers. A plug-type lock extends through an aperture in a casing and an opening in a base and, while so positioned, maintains them in secured relation. A key is inserted into the lock to rotate a latch element into a non-locking position, so that the lock can be removed and the housing opened for ready access to the light system.

Other objects of the invention include providing a lock for a warning light housing that can be incorporated into presently existing designs, and that is highly effective and durable, to withstand abusive treatment.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, but rather the invention may be employed in many different embodiments, and reference is made to the claims herein for interpreting the breadth of the invention.

BRIEF DESCRIPTION OF THE DRAWINGS

FIG. 3 is a view in cross-section taken along the plane of the line 3—3 shown in FIG. 2;

FIG. 4 is an exploded view in perspective of internal parts of the lock;

FIG. 5 is a view in perspective of an acuator key which may be used for the lock;

FIG. 6 is an end view of the lock of FIG. 1;

FIG. 7 is a view in cross-section taken along the plane of the line 7—7 shown in FIG. 6; and FIG. 8 is a view in cross-section taken along the plane of the line 8—8 shown in FIG. 7.

DESCRIPTION OF THE PREFERRED EMBODIMENT

Figure 1:
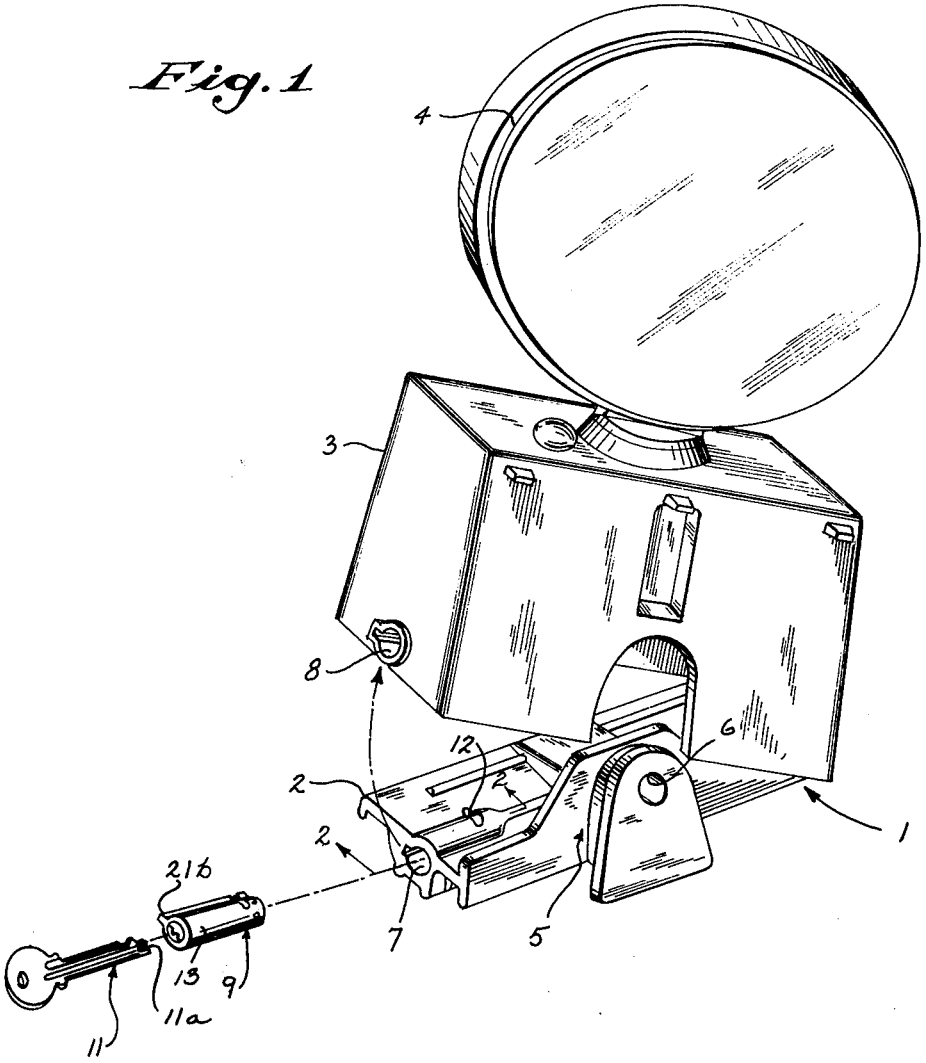
FIG. 1 is a view in perspective of a warning light housing together with a plug-type lock incorporating the present invention.

Referring to FIG. 1, the warning light shown includes a housing 1 which is composed of a base 2 and a casing 3. A lens and lamp assembly 4 resides on the top of the casing 3, and the electrical constituents of the light system--consisting essentially of batteries, switches, flasher circuit and lamp, and interconnecting wiring—are enclosed within the housing 1. Since the operation of this light system is not relevant to the present invention, further description thereof is unnecessary. The base 2 includes a bulkhead 5 on one of its longitudinal sides which provides a mounting structure for affixing the base 2 to a barricade. A through bolt (not shown) extends through a cylindrical bore 6 in the bulkhead 5 and projects into an aperture in the barricade in such manner that a special tool is required to attach or remove the base 2 therefrom. For further disclosure of the warning light housing 1 reference is made to the aforementioned U.S. Patent issued to Decker et al., U.S. Pat. No. 3,697,738, on Oct. 10, 1972.

Figure 2:
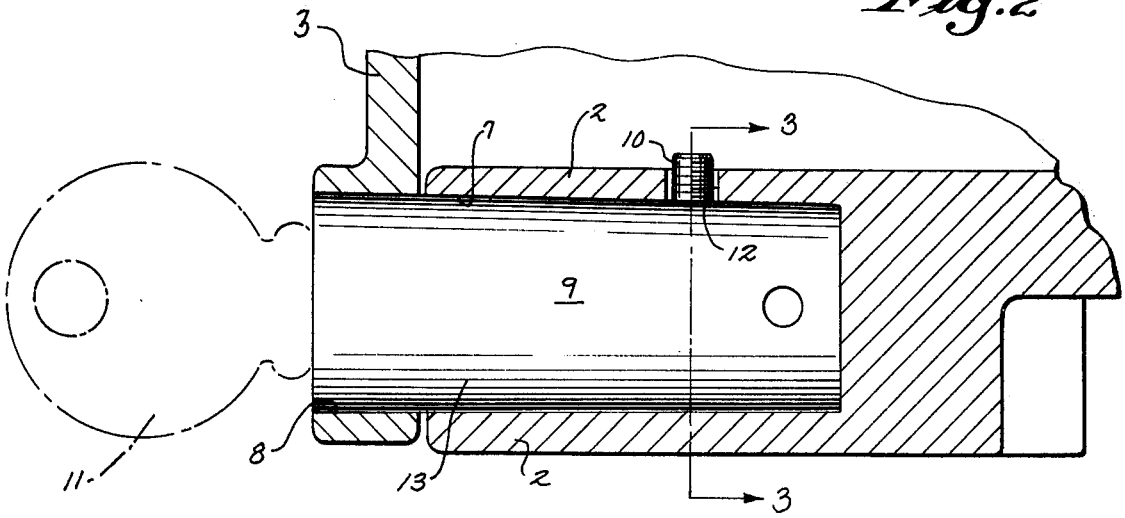
FIG. 2 is a view in cross-section taken along the plane of the line 2—2 shown in FIG. 1, with the plug-type lock inserted within the warning light housing.

Referring now to FIGS. 1–3, the casing 3 is pivotally connected to one end of the base 2 allowing it to be raised upwardly relative thereto. A chamber 7 is formed in the opposite end of the base 2, and the casing 3 has a lock aperture 8 which is congruent to the configuration of the entrance to the chamber 7. When it is desired to enclose the internal light system components, the casing 3 is lowered toward the base 2 until the lock aperture 8 aligns with the chamber 7. The chamber 7 combines with the lock aperture 8 to present a receptacle that receives a plug-type lock, generally indicated by the reference numeral 9. The lock 9 has the same generally cylindrical shape as the receptacle, and, when it is situated therein prohibits the casing 3 from moving or being moved with respect to the base 2.

To prevent the lock 9 from being removed from its receptacle, it is provided with a latch element 10 which is rotatable between a pair of positions upon actuation by a key 11. When the latch element 10 is in its locking position, it extends radially outward beyond the lock periphery through a slot 12 in the base 2. This engagement between the latch element 10 and the slot 12 prevents removal of the lock 9 from the receptacle, thus maintaining the base 2 and casing 3 in secured relation. The latch element 10 is depicted in dotted lines in FIG. 3 in its non-locking position. In this position, the locking element 10 lies within the lock periphery, allowing withdrawal of the lock 9 from the receptacle and permitting access to the interior of the housing 1.

Referring now to FIGS. 4–8, the lock 9 has an outer barrel 13 forming a lock housing with a longitudinal bore 14 and an arcuate opening 15 in its peripheral surface. The outer barrel 13 constitutes an enclosure for active lock elements journaled within its hollow interior. The active elements comprise primarily a key receptor 16, a collar 17, and a locking cylinder 18. In the assembled lock 9, the key receptor 16 is situated at the forward end, and is composed of a pair of halves 19 each having a neck 20 at its forward end. The key receptor halves 19 are spaced from one another to provide a channel therebetween—the forward end of the spaced necks 20 presenting an entrance for insertion of the key 11 and also presenting a stop for holding the receptor 16 within the barrel 13.

The collar 17 has an annular shape with its forward and rearward circumferential surfaces abutting the halves 19 of the key receptor 16 and the locking cylinder 18, respectively. The locking cylinder 18, which is rotatable within the barrel 13, is positioned at the rear end of the barrel. A key receiving projection 21 on the forward end of the locking member 18 extends into the collar 17, and a diametral indentation, or slot, is formed in the projection 21 and in part of the forward end of the main body of the locking cylinder 18. A block **21*a* extends laterally between the sides of the slot in the key receiving projection 21. Also, the latch element 10 is threaded in the body of the locking cylinder 18** to extend radially outward.

As previously mentioned, the latch element 10 is rotatable between locking and non-locking positions upon actuation by the key 11. To actuate the latch element 10, the key 11 is inserted into the channel of the key receptor 16, through the annular collar 17 and into the diametral slot in the locking cylinder 18. A small hollow **11*a* in the key 11 mates with the block 21*a*. While the key 11 is vertically oriented within the lock 9, the latch element 10 vertically extends radially outwardly from the locking cylinder 18 through the arcuate opening 15 beyond the periphery of the barrel 13. The latch element 10 is then in its locking position capable of registering with a hollowed-out portion in a structural member, such as the slot 12 in base 2. The latch element 10 is placed in its non-locking position by turning the key 11, so that both the key 11 and latch element 10 are horizontally disposed. In this position, the latch element 10 is in axial alignment with a land 21*b* that protrudes along a side of the barrel 13 so as to increase its radial thickness at this point. Thus, the latch element 10 now lies completely within the periphery of the barrel 13, and is also aligned with a groove in the receptacle 7, 8** so that the lock may be withdrawn.

The rotational movement of the latch element 10 is accomplished by turning the key 11. The key receptor 16 and the locking cylinder 18 are rotated in unison with the key 11. Since the locking cylinder 18 carries the latch element 10, the latter is similarly rotated co-extensively with the former.

The latch element 10 is retained within its locking and non-locking positions by a detent mechanism. A pair of apertures 22 and 23 are formed in the barrle 13 near its rearward end, and a radial compartment 24 is formed in the interior of the locking cylinder 18. A ball 25 is biased in aperture 22 when the latch element 10 is in its locking position, and in aperture 23 when the latch element 10 is in its non-locking position, by a spring 26 within compartment 24.

While the key 11 is being turned simultaneously rotating the key receptor 13, locking cylinder 18 and latch element 10 within the barrel 13, the annular collar 17 is stationary, being restrained against rotation by a set screw 27. The collar 17 has a semicircular ridge 28 at its forward end that lies in a transverse plane and conforms with a notch 29 in the key 11. During rotation of the key 11, the notch 29 rides over the ridge 28. With the key 11 vertically disposed in the locking position, the key 11 can be removed from the barrel 13, since the notch 29 is misaligned axially with respect to the entire ridge 28. However, if the key 11 is turned to the non-locking position, it is then confined within the lock housing 13, because the notch 29 will engage the ridge 28 upon attempted disengagement of the key 11 therefrom. This feature allows removal of the lock 9 from the receptacle in the warning light housing 1 by a pulling of the key 11 outwardly therefrom. With the lock 9 thus removed, however, the key 11 is still constrained within the lock housing 13 preventing accidental misplacement while the housing 1 is open.

The key receptor halves 19 further enhance the security features of the lock 9. Since costly and complex tumblers are avoided in the lock structure, the locking cylinder 18 could be rotated, for example, by an ordinary screwdriver. The key receptor halves 19 are specially constructed to prevent actuation of the latch element 10 by blocking insertion of a screwdriver, thin blade or other false device into the lock 9. Also, it is necessary for the hollow **11*a* in the key 11 to mate with the block 21*a* in the key receiving projection 21 to actuate the latch element 10**. This construction assists in repelling actuation by a structurally similar yet non-identical key.

Although the above described plug-type lock 9 has been used in association with a warning light housing 1, it should be readily apparent to those skilled in the art that the lock 9 does not necessitate this application, but can be utilized in numerous devices. Moreover, presently existing constructions can be readily adapted to incorporate this security device. With respect to the warning light shown, the lock 9 allows convenient access to the interior of the warning light housing 1 by authorized maintenance workers, yet protects the housing 1 and the light system components contained therein from theft and invidious tampering.

I claim:

1. In combination with a housing for a warning light of the type wherein a removable casing is pivotally connected at one end to a base, and wherein the casing has an aperture at its opposite end which aligns with an opening in the base, wherein the improvement comprises:

a key;

a plug-type lock which is received by the opening in said base and the aperture in said casing to prevent relative movement therebetween while disposed therein, said lock having:

a lock housing having an interior which receives said key;

a locking cylinder rotatable within said lock housing having a radially extending latch element, and a key receiving slot at one end that faces axially into said lock housing;

said latch element extending radially outwardly from the interior of said lock housing, and being movable between locking and non-locking positions upon actuation by said key, the locking position restraining and the non-locking position allowing removal of said lock from said base and said casing;

a key receptor rotatable within said lock housing having an axial key receiving channel, and that turns with said locking cylinder upon insertion and rotation of said key; and an arched key restrainer within said lock housing and disposed axially between said locking cylinder and said key receptor presenting a ridge lying in a transverse plane adapted to match a key notch upon insertion and turning a proper key.

2. The combination as recited in claim 1, wherein in its locking position said latch element extends radially outwardly beyond the periphery of said lock housing, and in its non-locking position lies within the periphery of said lock housing.

3. The combination as recited in claim 1, wherein in its locking position said latch element is retained within a slot in said base.

4. The combination as recited in claim 1, wherein said latch element and said key are substantially perpendicularly disposed with respect to said base when said latch element is in its locking position and are substantially parallel thereto when said latch element is in its non-locking position.

5. In a lock mechanism, the combination comprising:

an outer barrel for housing lock elements, and having a circumferential opening extending through a sector of its perimeter;

a locking cylinder rotatable within said barrel having a radially extending latch element passing through said circumferential opening, and a key receiving slot at one end that faces axially into said barrel;

a key receptor rotatable within said barrel having an axial key receiving channel, and that turns with said locking cylinder upon insertion and rotation of a key; and an arched key restrainer within said barrel and disposed axially between said locking cylinder and said key receptor presenting a ridge lying in a transverse plane adapted to match a key notch upon insertion and turning a proper key.

6. A lock mechanism as in claim 5 wherein said barrel has a radial enlargement, and said radially extending latch element axially aligns with said enlargement upon rotation of said locking cylinder into an unlocking position.

7. A lock mechanism as in claim 6 wherein said locking cylinder has a structural member adapted to engage a key hollow upon insertion and turning a proper key.

8. A lock mechanism as in claim 7, wherein said locking cylinder includes a detent mechanism which selectively retains said latch element in locking and nonlocking positions.

9. A plug-type lock, comprising:

a lock housing having a hollow interior, said housing being an enclosure for lock elements which are actuated to a locking position to prevent removal of said plug-type lock from engagement with a pair of members to retain them in secured relationship, said lock elements comprising:

a key receptor having a key-receiving entrance in its forward end and having a longitudinal channel therein extending from the key-receiving entrance to its rearward end;

a movable locking cylinder having a key-receiving slot in one end and having a latch element associated therewith;

an arched key restrainer within said lock housing and disposed axially between said locking cylinder and said key receptor presenting a ridge lying in a transverse plane adapted to match a key notch upon insertion and turning a proper key; and a key insertable within the key-receiving entrance to pass through the channel in said key receptor and the key-receiving slot to engage said movable locking cylinder and actuate said latch element between locking and non-locking positions.

10. A plug-type lock, comprising:

a lock housing having a longitudinal bore and an arcuate opening:

a key receptor disposed within said lock housing which includes a pair of key receptor halves that are spaced from one another to provide a channel therebetween;

a locking cylinder which is rotatable within said lock housing having a key-receiving projection in its forward end extending into said collar, said key-receiving projection including a diametral indentation, and having a radial latch element extending from its periphery outwardly through the arcuate opening in said lock housing, said latch element being rotatable between locking and non-locking position;

an arched key restrainer within said lock housing and disposed axially between said locking cylinder and said key receptor presenting a ridge lying in a transverse plane adapted to match a key notch upon insertion and turning a proper key; and a key, which extends longitudinally of said lock housing therewithin and passes through the channel between said key receptor halves and said annular collar into the diametral indentation in said key-receiving projection engaging said locking cylinder whereby rotation of said key rotates said latch element between its locking and non-locking positions.

* * * * *